United States Patent [19]

Barker

[11] 4,126,561

[45] Nov. 21, 1978

[54] COMPOSITION FOR TREATING FABRICS, METHOD FOR MAKING AND USING THE SAME

[76] Inventor: Graham Barker, 16-11 Berdan Ave., Fairlawn, N.J. 07410

[21] Appl. No.: 875,314

[22] Filed: Feb. 6, 1978

Related U.S. Application Data

[63] Continuation-in-part of Ser. No. 486,351, Jul. 8, 1974, Pat. No. 4,077,890, which is a continuation-in-part of Ser. No. 335,311, Feb. 23, 1973, abandoned.

[51] Int. Cl.[2] ..... D06M 13/24

[52] U.S. Cl. ..... 252/8.6; 252/307; 427/240; 428/392; 424/26

[58] Field of Search ..... 252/8.6, 8.8, 8.75, 252/307; 106/208; 427/240, 242; 428/213, 392; 424/26

[56] References Cited

U.S. PATENT DOCUMENTS

| | | | |
|---|---|---|---|
| 1,807,810 | 6/1931 | Rice | 252/307 |
| 1,907,982 | 5/1933 | King | 252/307 |
| 2,826,506 | 3/1958 | Trusler | 106/208 |
| 2,949,426 | 8/1960 | Thiegs | 252/307 |
| 3,227,192 | 1/1966 | Griffiths | 428/392 |
| 3,442,692 | 5/1969 | Gaiser | 427/240 |
| 3,634,947 | 1/1972 | Furgal | 427/242 UX |
| 3,650,816 | 3/1972 | Rudy et al. | 252/8.6 X |
| 3,676,199 | 7/1972 | Hewitt et al. | 428/213 |
| 3,681,248 | 8/1972 | Gould et al. | 252/89 |
| 3,736,668 | 6/1973 | Dillarstone | 427/242 |
| 3,803,285 | 4/1974 | Jensen | 264/143 |
| 3,822,145 | 7/1974 | Liebowitz | 252/8.75 |
| 4,041,205 | 8/1977 | Compa et al. | 252/8.6 |

FOREIGN PATENT DOCUMENTS

| | | | |
|---|---|---|---|
| 255,242 | 11/1964 | Australia | 252/307 |
| 1,240,713 | 7/1971 | United Kingdom. | |

*Primary Examiner*—William E. Schulz

[57] ABSTRACT

Composition for imparting desirable properties to fabrics or clothes comprising a water-soluble or dispersible adhesive such as a gum or polymeric resin, a fine, water-insoluble particulate and at least one adjuvant capable of imparting desirable properties to the fabrics or clothes such as a fabric softener, for example. The composition is quickly disintegrable upon heat and moisture to release the adjuvant on the fabrics or clothes while leaving substantially no residue of gum thereon or in the surrounding environment, such as a clothes dryer. It can be foamed or unfoamed condition but is preferably foamed and made by mixing the constituents, that is, the gum particulate and adjuvant, and then whipping the mixture where a foam is desired and subsequently drying the mixture to form the composition.

14 Claims, No Drawings

COMPOSITION FOR TREATING FABRICS, METHOD FOR MAKING AND USING THE SAME

RELATED APPLICATIONS

This is a continuation-in-part of copending application Ser. No. 486,351, filed July 8, 1974 now U.S. Pat. No. 4,077,890, which, in turn, was a continuation-in-part of application Ser. No. 335,311, filed Feb. 23, 1973 and now abandoned, the contents of each of which are incorporated herein, by reference, and for which all legal and equitable rights are requested.

This invention relates to a new composition of matter and a method for making and using the same. More particularly, the invention relates to a new composition for treating fabrics to impart desired properties thereto and to a method for making and using the same.

For many years, it has been known to add various types of adjuvants to detergents and wash cycle additives. It is also known to add adjuvants to dryers. In general, however, the adjuvants added to the wash or rinse cycles have the objective of removing soil from the fabric. However, the presence of detergents and the like in the washing machine makes it difficult to concurrently apply adjuvants which are to be present on the fabric after washing and drying. Consequently, events led to the development of adjuvants for use in dryers. In general, such adjuvants are supplied in the form of sprays or liquid coating agents and it is most difficult when using such materials in dryers to obtain substantially even distribution of the adjuvant on the fabrics. Furthermore, chemical sprays and liquid compositions have the additional drawback in that they generally contain constituents which leave undesirable residue in the dryer and/or on the fabric. This occurs essentially from the fact that the carrier component of the composition has to be predominant and, therefore, generally constitutes a major proportion of the composition.

Recently, a product has been developed using a flexible fabric substrate on which an adjuvant, such as a fabric softener, has been applied. This product is disadvantageous in that the fabric substrate remains in the dryer and must be removed from amongst the clothes after the drying cycle. More critical, however, is the fact that the fabric substrate tends to cling and become enmeshed with the clothes and at times is difficult to find after use.

Still further, common adjuvants for use in dryers have only included softeners and antistatic agents. The color enhancers, color brighteners, fresheners, atmosphere scents and the like have not been employed in dryers to apply them to clothes in dryers primarily because of the lack of suitable vehicle to accomplish this.

There exists, therefore, a need for providing compositions which can be employed in clothes dryers but which do not exhibit the disadvantages mentioned above.

It is an object of this invention to provide a composition of matter for treating clothes and to impart to the clothes any of a selected group of desired properties, such as softness, anti-static properties, scents or perfumes and brightening characteristics and the like.

It is another object of the invention to provide a solid composition for fabrics or clothes which is simple and easily formed and which totally disintegrates in the dryer, leaving no residue, remainder, substrate and the like.

These objects, as well as others, together with the numerous advantages thereof are set forth in the following disclosure of the present invention.

In accordance with the invention, there is provided a new composition for treating fabrics or clothes to impart desired properties thereto comprising a minor amount of a water-soluble or dispersible gummy material and at least one adjuvant capable of imparting desired properties to the fabrics or clothes, the composition being shaped into a substantially dry manipulatable form which is substantially completely and quickly disintegrable upon the subsequent application of heat and in the presence of moisture and agitation and which will substantially completely uniformly release all of the adjuvant onto fabrics or clothes in contact therewith and leave substantially no residue of gum on the fabric and in the environment around the fabrics, as well as to the method for making and using the same.

The inclusion in the composition of certain water soluble and dispersible additives results in unexpected improvements in the performance of the foamed dryer additive as previously divulged in my prior patent application Ser. No.486,351. It has now been discovered that through the incorporation of fine, water insoluble particulates of 1–200$\mu$ particle size, the breakdown of the foamed product is controlled so that quicker breakdown by disintegration of the shaped composition can be achieved. Thus, one can control the fragility of the foamed product by the addition of 10–80% by weight, based on 100% solids on a dry basis of the insoluble fine particulate. The addition of 10–50% particulate controls the breakdown to within the first 2–5 minutes of the dryer cycle. Addition of 50–80% controls the breakdown to within the first one to two minutes of the dryer cycle. The overall strength of the foamed formed product is not affected so that the product can be packaged and handled without undesirable excessive fragility.

Examples of water insoluble particulates are Ca, Mg, Zinc, Al, and other polyvalent metal carbonates, silicates, and sulfates. Other suitable particulates having particle size ranges of 1–200 microns are powdered cellulose (e.g., Solka-Floc), fumed silica, bentonite, attapulgite, diatomaceous earth, water insoluble clays and cationic alumina.

Preferably, the water-soluble gum is a plastic material capable of being mixed with the adjuvant and, with subsequent foaming or aeration, forming a rigid, low density mass therewith. Preferably, the composition is formed into balls, discs, wafers or bodies, which because of their structure, are disintegrable over a period of time, thus providing a further advantage in giving a sustained timed release distribution of the adjuvant.

According to the invention, the composition contains an amount of water-soluble gummy material sufficient only to provide support for the adjuvant. In general, based on 100% solids on a dry basis, the composition contains no more than 10% gum and may contain as little as 0.1%. Preferably, the amount of gum would be 1–5%.

Based upon 100% solids, the adjuvant may therefore range between 10–85%, consituting a percentage of active ingredients (i.e. the ingredient imparting the desired properties) far in excess of that in effect to date in any of the known fabric treating products.

The water-soluble gummy materials can vary widely and may be ethylhydroxyethyl cellulose (E H E C), polyvinyl alcohol (P V A), carboxymethyl cellulose (C M C) ) (although this latter should be used only with the nonionic softeners), hydroxyethyl cellulose (H E C) and hydroxy propyl cellulose and the like. Preferably, these gums should be of high viscosity, that is a Brookfield Viscosity over 1000 using standard spindle and temperature. In addition, carbohydrate gums, in general, may also be used. Among the suitable carbohydrate adhesives are animal gums, plant gums and derivatives, starches, starch ethers, amylose, amylopectin and their ester and ether derivatives, locust bean gum, guar gum, gum arabic and related seed gums and plant exudate gums, marine plant gums, such as algins, carrageenans, laminarins and agar, and water dispersible protein gums of the classes such as animal proteins, for example, hydrolyzed keratins and egg albumin and vegetable proteins such as gluten. Additional water-soluble, and dispersible and film forming polymers are those in the following list, but are not limited to these polymers.

1. Polyvinylpyrollidone and water-soluble or dispersible copolymers with vinylacetate
2. Polyacrylamides—and copolymers of acrylamide and other polar vinyl compounds
3. Polyox (polyethylene glycols)
4. Polyacrylates, polymethacrylates, vinyl acetate latices and other copolymers and terpolymers with polycrotonates—allyl ethers and esters
5. Salts of polyacrylates, $Na^+$, $K^+$, amine
6. Styrene-maleic anhydride, ethylene-maleic anhydride (E M A) and other maleic anhydride copolymers and terpolymers, as their basic salts
7. Carboxylate Butadiene—Styrene copolymers The above list is only indicative and other suitable polymers are obvious to those skilled in the art.

A wide variety of adjuvants can be employed in the composition of the invention. More specifically, adjuvants useful in the composition of this invention include, but are not limited to those set forth hereinafter:

Fabrics softeners such as quaternary ammonium compounds of the formula (I) $N(R_1R_2R_3R_4)X$, where $R_1$ and $R_4$ are a $C_{16}$ to $C_{20}$ alkyl group, $R_2$ and $R_3$ are a $C_1$ to $C_4$ alkyl and X is an anion imparting water dispersibility to the cationic ammonium compound, and the reaction product of about 2 moles of a fatty acid of the formula $R_5COOH$ and hydroxyethylene-diamine where $R_5$ is alkyl groups of $C_{13}$–$C_{17}$.

Typical commercial products commonly available for use in the present invention include distearyl dimethyl ammonium chloride, such as sold by Armour Chemical Corp., under the Trade name ARQUAD 2 HT (hereinafter generally referred to as 2HT) and the reaction product of approximately 2 moles of stearic acid with approximately 1 mole of hydroxyethylene diamine. The last mentioned product has a mixed chemical structure due to the multifunctional characteristics of the diamine reactant. Spectral analysis of a commercial product prepared through the fatty acid-diamine reaction indicates that it contains on the order of 25 percent quaternary compounds of the imidazoline type, the balance thereof being mixed esters and amides. Softeners related to this last mentioned compound also include the quaternized products of about 2 moles of oleic acid reacted with 1 mole of hydroxyethylene diamine and the product of about 2 moles of a mixture of oleic and stearic acids reacted with about 1 mole of hydroxyethylene diamine. Other suitable fabric softening agents which may be used in the present invention include those which have been described in "Proceedings of the American Association of Textile Chemists and Colorists," American Dyestuff Reporter, pages P42 and P43, Jan. 28, 1957.

Optical brighteners such as disulfonated diaminostilbene compounds disclosed in Alien Property Custodian publication No. 381,856, and U.S. Pat. No. 2,612,501, and triazole compounds of the type disclosed in U.S. Pat. No. 2,784,183 can also be employed in the composition of the invention.

Essential oils and fragrances can also be used in the compositions of the invention. In using materials of this category, however, since many substances of this type are normally in liquid form, they must be combined with a suitable carrier having the desired waxiness, thermal stability, and hardness to obtain a suitable composition. Suitable waxy carriers which may be used as needed are discussed below.

Antistatic agents which in many cases are compounds of the same general structure discussed above with respect to fabric softening compounds can also be used in this invention. Quaternary ammonium compounds, as well as other fabric softening agents may be enhanced by combining these materials with ethanolamides such as tallow ethanolamide and tallow diethanolamide.

Certain cationic alumina, in addition to their primary role as fine particulates, impart desirable antistatic effects to synthetic fabrics in the dryer. Such a product is sold commercially as Dispal by Philadelphia Quartz Co. of Philadelphia, Pa.

It is also offered as an aqueous dispersion called Q-Loid. Either product offers the same excellent antistatic effect.

Germicides such as the halogenated salicylanilides, hexaclorophene, neomycin sulfate, benzalkonium quaternary compounds, and the like can also be employed. The halogenated salicylanilides which have found the most widespread acceptance are tribromosalicylanilide and polybromosalicylanilide, the latter being a mixture primarily of dibromosalicylanilide and tribromosalicylanilide.

Soil release agents such as the polyacrylic polyvinyl alcohol compositions described, for example, in U.S. Pat. No. 3,377,249, can also be used.

Non-ionic agents, fatty amides and fatty ethoxylides may also be used as softening agents. Among these are Amide Types characterized by the formula

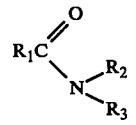

(III)

wherein $R_1$ is derived from $C_{12}$ to $C_{18}$ saturated fatty acids, and $R_2$ and $R_3$ are $—C_2H_4OH$ or $—C_2H_4NH_2$, respectively. For example, this type would include stearic diethanolamide. Non-ionic types of materials such as fatty ethoxylate esters and ethers characterized by the formulae:

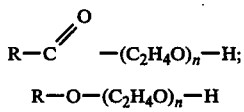

and $$R—O—(C_2H_4O)_n—H$$

wherein $n$ is 3 to 20 and derived from 3 to 20 mols of ethylene oxide can also be employed in the compositions of this invention. These types of materials also include ethoxylated monoglycerides having the formula:

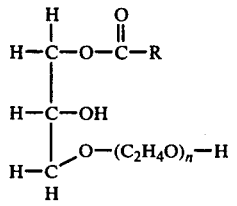

wherein $n$ is as defined above and R is derived from a $C_{12}$–$C_{18}$ saturated fatty acid. For example, the ethoxylated-glycerylmonostearate with 10 mols of ethylene oxide may be used.

The additives which may be used herein also include polyglycols.

Preferably the gummy material is premixed in water to form a solution having a low solid to water ratio, suitably in the range of 1–20% solutions. The greater the percentage of water, the less the density of the resultant product; the mixing procedure and drying rates are directly influenced by amount of water used. Preferably, a 2–5% solution of gum is used.

The solution is prepared and to it are added the adjuvants and water insoluble particulates in the desired amounts. The mixture is blended until a uniform dispersion is formed, and then aerated or foamed, and may then be cast, molded, shaped, etc., and dried in sizes and shapes of any desired configuration. Preferably, the blended mixture is whipped to create a foam. A desirable foam resulting from the whipping action would have a density range of 0.2 to 0.8 and a bubble size of 5 to 50 microns. Whipping should therefore be controlled to obtain such limits. The gums are all good foamers and do not necessarily require foaming agents or starters, although they may be used. The mixture is whipped until a rigid stable foam is produced, and is thereafter extruded, ladled or spooned into individual portions and dried by forced heating or by allowing the water to evaporate under ambient temperature and humidity conditions. Preferably, the composition is dried to a relative moisture content of less than about 2%.

The composition can be shaped before or after drying. Drying can be done in convection ovens, gas dryers, and the like.

The resultant product comprises a low density mass because of the use of relatively minor amounts of gum and a high concentration of the adjuvant. The density of the product can be varied by varying the percentage of water in the mixture. By raising the percentage of water over 60%, the density may be decreased even further, although of course drying time may be increased.

Preferably, the foam is formed into disks, balls or wafers of approximately 3–10 grams in weight. The size or volume of such balls will, of course, depend upon the density of the foam. Because of the structure and physical properties of the ball or disc, the foam disintegrates over a short period of time, providing a time release to the adjuvant held therein. The rate of disintegration is also dependent upon the exposed surface of the shape, and the percentage of water insoluble particulate. Therefore, a ball may be preferred since it presents the largest surface. A ball of approximately 3 grams will disintegrate over a period of 5 minutes or less. Thus, the present invention provides for release of adjuvant uniformly over a sustained time period, insuring that all portions of fabric on clothes tumbled in the dryer will receive adjuvant, and the absorption of all the adjuvant by only a portion of the fabric on clothes is prevented. Since all of the plastic is disintegrable, all of the adjuvant in the foam is released. It is to be noted again that the adjuvant may comprise 10 to 85% of the foam, well above the level of active ingredients found in known products.

The combination of EHEC type gums and/or methocel with the P.V.A. and HEC type gums can be advantageously made to provide a composition in which the release time can be selectively controlled.

Release time is further controllable by varying the size of the shaped product formed from the composition, as well as the density of the composition, since it will be obvious that in either event the bulk amount of the plastic carrier determines the rate at which release of the adjuvant occurs.

The following examples are given as being illustrative of the present invention. In the Examples all parts and percents are by weight unless otherwise stated.

EXAMPLE I

A 2% solution of Cyanomer P-250 (trademark of American Cyanamid for polyacrylamide) was prepared. To 50 grams of this solution, 5 grams of Polyglycol 400 and 10 grams of powdered cellulose were added with mixing. When the mixture was uniform, 40 grams of 2HT powder were added and the lutive mixture was subject to whipping in a Waring Blender until a stable foam was obtained. The wet foam was extruded onto drying trays and dried to less than 2% moisture content. The resulting mass, when dried, had the following composition:

1.78% Polyacrylamide
17.80% Powdered cellulose
8.90% Polyglycol 400
71.52% Dihydrogenated tallow dimethyl ammonium chloride The dried foam composition, when added to a household clothes dryer as a 2 gm ball, together with a load of wet clothes resulted in leaving the clothes with a soft feel and free of static electricity and minimized ironing.

EXAMPLE II

A 10% solution of polyvinyl pyrollidone (GAF-brand PVP-K-90) was prepared. To 35 grams of this polymer solution, 20 grams of ethoxylated glyceryl monostearate, 3 grams of sodium lauryl sulfate and 20 grams $CaCO_3$ were added. The entire mixture was blended until uniform and 60 grams of water were added. It was then whipped in a Hobart mixer until a stable foam resulted. The foam was treated, as in Example I, and had the same results when used with wet clothes in a dryer. The final composition of the dried foamed mass was as follows:

| | |
|---|---|
| Calcium Carbonate | 43% |
| Ethoxylated Glyceryl monostearate | 43% |
| Sodium lauryl sulfate | 6.5% |
| Polyvinyl pyrollidone (PVP K-90) | 7.5% |

EXAMPLE III

A 10% solution of Polyox WSR 301 (Union Carbide—high molecular weight polyethylene oxide) was prepared. To 50 grams of this resin solution 20 grams of Arosurf TA-100 (Ashland Chemical) and 20 grams zinc silicate were added. The mixture was then placed in a Hobart Mixer. 5 grams of Polyglycol 400 were then added and the mix was then whipped until a stable foam was obtained. When extruded and dried, the dried foam mass had the following composition:

| | |
|---|---|
| Zinc Silicate | 40% |
| Ditallow dimethyl ammonium chloride | 40% |
| Polyethylene oxide (Polyox) | 10% |
| Polyglycol 400 | 10% |

The dried foam, when added to the dryer, gave the same results as described in Example I.

EXAMPLE IV

In a Hobart Mixer, 40 grams of molten ethoxylated glyceryl monostearate and 300 grams of water were blended until uniform. Then, 5 grams of sodium lauryl sulfate powder were added and the entire mixture was then whipped to a stable foam. 15 grams of bentonite were then blended into the foam, followed by 11 grams of UCAR Latex 680, a 46% solid styrene-acrylic interpolymer manufactured by Union Carbide Corp. The stiff stable foam was then extruded onto dryer trays and dried and tested in a clothes dryer as in Example I with the same results. The composition of the dried mass was as follows:

| | |
|---|---|
| Ethoxylated glyceryl monostearate | 61% |
| Bentonite | 23% |
| Styrene Acrylic interpolymer | 7.7% |
| Sodium Lauryl sulfate | 7.7% |

EXAMPLE V

Stearic Diethanolamide was used instead of ethoxylated glyceryl monostearate as in Example IV and the entire procedure of Example IV was followed with the same results.

EXAMPLE VI 10 grams of Catrex* resin solution were added to 200 grams of water. To this, 10 grams fumed silica (Cabosil—a product of Cabot Corp.), 10 grams Polyglycol 600 and 50 grams of Varisoft 475 (a 75% aqueous paste of methyl 1-alkylamidoethyl 2-alkyl imidazolinium methosulfate manufactured by Ashland Chemical Co.) was added; the entire mass was mixed in a Hobart Blender and was then whipped until a stable foam was obtained. The stable foam was extruded onto drier trays and dried to a moisture content of less than 3%. The dry foamed mass, when in a dryer as in Example I, gave the same results. The composition of the dried product was as follows:

| | |
|---|---|
| Catrex resin* | 8% |
| Silica | 16% |
| Polyglycol 600 | 16% |
| Methyl alkylamidoethyl 2-alkyl imidazolinium methosulfate | 60% |

*Catrex is a trade name of National Starch for their cationic resin.

EXAMPLE VII

To 90 grams of water, 9 grams of aqueous Natrosol 250 MR (2% soln.) (Hercules Chemical—hydroxy ethyl cellulose) solution and one gram of 10% aqueous solution of Cyanomer P-250 were added, and the solution was mixed until clear. 10 grams of Polyglycol 400 and 15 grams of zinc carbonate were then added during the blending operation. 53 grams of Adogen 442 were then added, and the entire mixture was then blended at a higher speed until a stable foam was obtained. The foam density was 0.22 and the bubble size was uniform and 5–10 microns. The foam was extruded and dried as in previous examples and treated in a clothes dryer with results obtained similar to Example I. The composition of the dried foam was as follows:

0.44% Natrosol 250 MR
0.15% Polyacrylamide
15.00% Polyglycol 400
23.00% Zinc Carbonate
61.41% Ditallow dimethyl ammonium chloride

EXAMPLE VIII

Example VII was repeated using stearyl betaine stead of Adogen 442 and the final dry foam had the properties when evaluated as in Example I.

EXAMPLE IX 10 grams of stearic diethanolamide were melted into 360 grams of water to yield a 10% aqueous dispersion. 5 grams of sodium lauryl sulfate were added to the thick paste, and the entire mass was then whipped in a Hobart Mixer for 10 minutes. To the dense foam 8.35 grams of UCAR Latex 131 (Union Carbide's 60% solids polyvinyl acetate latex) and 30 grams of Dispal (cationic alumina) were added, and the entire mass was mixed until uniform. The dense foam was then extruded onto drying trays and dried to a moisture level of less than 1%. The dried foam, when added to the dryer as in Example I, softened clothes and eliminated static electricity. The resulting composition was as follows:

| | |
|---|---|
| Dispal Alumina | 60% |
| Stearic Diethanolamide | 20% |
| Sodium Lauryl Sulfate | 10% |
| Polyvinyl Acetate | 10% |

EXAMPLE X

The procedure of Example VI was followed, with 20 grams of cationic alumina and 15 grams of Polyglycol 1000 monostearate being substituted for the fumed silica and Polyglycol 600. The resulting dry foamed mass, when tested in a dryer as in Example I, exhibited excellent softening properties on fabrics and eliminated static electricity on synthetics.

What is claimed is:

1. A solid, shaped composition for treating fabric materials to impart desired properties thereto comprising a homogeneous mixture, based on 100% solids on a dry weight basis, of 0.1 to 20% by weight of a water soluble or dispersible film former adhesive, 10–80% by weight of a water-insoluble fine particulate and 10 to 85% by weight of adjuvant capable of imparting desired softness, brightness, fragrance, antistatic, germicidal and/or soil release properties to said fabric materials, said adhesive being present in an amount to form with said adjuvant a uniform, integrated, self-supporting cellular foam having a density in a range of 0.2 to 0.8, and a bubble size in a range of 5 to 50 microns, said foam being dried to a moisture content of less than about 2% and capable of maintaining a given shape under external stress, said composition being disintegrable over an extended period of time in or under agitation upon the application of warm air and in the presence of moisture to release substantially all of said adjuvants and to leave substantially no residue of said adhesive.

2. The composition according to claim 1, wherein said adhesive is selected from the ghe group consisting of animal gums, plant gums, seed gums, plant exudate gums, marine plant gums, water-dispersible protein gums, starches, starch ethers, amylose, amylopectin and their ester and ether derivatives, polyethylene glycols, polyvinylpyrrollidone and its copolymers with vinyl acetate, acrylates and acrylamides, polyacrylamides, polyacrylates, polymethacrylates, alkali metal and amine salts of polyacrylates and polymethacrylates, polyvinyl acetates, water soluble copolymers of acrylates, methacrylates and vinyl acetates with crotonates or allyl ethers and esters, styrene-maleic anhydride and ethylene-maleic anhydride copolymers and carboxylated butadiene-styrene copolymers 3. The composition according to claim 1, wherein said water-insoluble fine particulate is selected from the group consisting of calcium, magnesium, zinc and aluminum carbonates, silicates and sulfates, powdered cellulose, fumed silica, bentonite, attapulgite, diatomaceous earth, water-insoluble clays and cationic alumina.

4. The composition according to claim 1, wherein the adjuvant is an antistatic agent.

5. The composition according to claim 1, wherein the adjuvant is a color enhancer and optical brightener.

6. The composition according to claim 1, wherein the adjuvant is a fabric softener.

7. The composition as defined in claim 6, wherein the fabric softener is distearyl dimethyl ammonium chloride.

8. The composition as defined in claim 6, wherein the fabric softener is the reaction product of a fatty acid of the formula, $R_5COOH$ and hydroxyethylene diamine wherein $R_5$ is a $C_{13}$ to $C_{17}$ alkyl group.

9. The composition as defined in claim 6, wherein the fabric softener is selected from the group consisting of the ethoxylated non-ionic reaction product of fatty alcohols, fatty acids, and esters containing $C_{16}$–$C_{20}$ fatty groups and a labile hydrogen capable of reacting with ethylene oxide up to a content of 3–10 mols ethylene oxide.

10. The composition as defined in claim 1, wherein the adjuvant is a germicidal agent.

11. The composition as defined in claim 1, wherein the adjuvant is a fragrance imparting agent.

12. A shaped composition for treating fabric materials to impart desired properties thereto comprising a homogeneous mixture, based on 100% solids on a dry weight basis, of 0.1 to 20% by weight of hydroxyethyl cellulose adhesive, 10–80% by weight of a water-insoluble fine particulate and 10–85% by weight of adjuvant capable of imparting desired softness, brightness, fragrance, antistatic, germicidal and/or soil release properties to said fabric materials, said adhesive being present in an amount to form with said adjuvant a substantially uniform self supporting, manipulatible foam mass having a density in the range from 0.2 to 0.8, and a bubble size in the range from about 5 to 50 microns, said mass being dried to a moisture content of less than 2% so as to maintain a given shape under external stress, said composition being disintegrable over an extended period of time under agitation upon the application of heat and in the presence of moisture to release substantially all of said adjuvants and to leave substantially no residue of said adhesive.

13. The composition according to claim 12, wherein the adjuvant is an antistatic agent.

14. The composition according to claim 3, wherein the particle size of said fine particulate is in the range from 1 to 200 microns.

* * * * *